US005605362A

United States Patent [19]

Surko, Jr.

[11] Patent Number: 5,605,362

[45] Date of Patent: Feb. 25, 1997

[54] EXIT DEVICE HAVING A DEADBOLT AS ITS SECURING MEMBER

[75] Inventor: Walter E. Surko, Jr., Southington, Conn.

[73] Assignee: Yale Security Inc., Monroe, N.C.

[21] Appl. No.: 527,101

[22] Filed: Sep. 12, 1995

Related U.S. Application Data

[63] Continuation of Ser. No. 144,243, Nov. 1, 1993, abandoned.

[51] Int. Cl.[6] ..... E05B 65/10; E05C 1/02

[52] U.S. Cl. ..... 292/92; 292/192; 292/166; 292/DIG. 65

[58] Field of Search ..... 292/92, 5, 7, 21, 292/93, 94, DIG. 24, DIG. 65, 192, 166

[56] References Cited

U.S. PATENT DOCUMENTS

| | | | |
|---|---|---|---|
| 203,787 | 5/1878 | Smith . | |
| 220,318 | 10/1879 | Underhill . | |
| 242,247 | 5/1881 | Bailey . | |
| 327,833 | 10/1885 | Sparks . | |
| 385,474 | 12/1932 | Yardley . | |
| 1,192,449 | 7/1916 | Ottinger . | |
| 2,073,149 | 3/1937 | Geyer | 292/337 |
| 2,290,727 | 7/1942 | Best | 292/172 |
| 2,290,728 | 7/1942 | Best | 292/172 |
| 2,644,705 | 7/1953 | Hagstrom | 292/169 |
| 2,656,207 | 10/1953 | Russell et al. | 292/169 |
| 3,432,631 | 3/1969 | Deutscher et al. | 292/92 |
| 4,080,810 | 3/1978 | Fishman | 70/129 |
| 4,083,590 | 4/1978 | Folger | 292/92 |
| 4,566,725 | 1/1986 | Klein | 292/191 |
| 4,576,405 | 3/1986 | Wartian | 292/191 |
| 4,656,849 | 4/1987 | Rotondi et al. | 70/134 |
| 4,796,931 | 1/1989 | Heid | 292/92 |
| 5,044,182 | 9/1991 | Totten | 70/143 |
| 5,174,617 | 12/1992 | Huber et al. | 292/128 |

*Primary Examiner*—Steven N. Meyers
*Assistant Examiner*—Tuyet-Phuong Pham
*Attorney, Agent, or Firm*—Michael G. Johnston, Esq.; Moore & Van Allen, PLLC

[57] ABSTRACT

This exit device has a press bar and an elongated deadbolt adapted to be mounted horizontally adjacent the free end of the door and a pivoted retractor blade inward of the door. The blade is pivoted by the press bar and engages with its nose a projecting surface on the deadbolt and retracts the deadbolt. The blade also has a keeper contact surface which, as the door closes, is contacted by the keeper and the blade is pivoted inward to retract the deadbolt. The retractor blade also serves as an anti-friction bearing having a peripheral portion which rolls against the deadbolt and counters against the inward force on the deadbolt opposing to the opening force on the door.

38 Claims, 4 Drawing Sheets

EXIT DEVICE HAVING A DEADBOLT AS ITS SECURING MEMBER

This is a continuation of application Ser. No. 08/144,243, filed on Nov. 1, 1993, now abandoned.

BACKGROUND OF THE INVENTION

1. Field of the Invention

This invention relates to an exit device having deadbolt as its securing member, and more particularly to an exit device including a press bar on the inside of a door. When the press bar is pushed, it retracts the securing member so that the door can be opened.

2. Description of Related Art Including Information Disclosed Under §§1.97 to 1.99

State and federal codes have required that exit doors for public buildings be equipped with exit devices so that occupants exiting a building can press a panic bar or press bar to actuate the latchbolt of the door. Such pressing—as opposed to turning a handle or knob—is natural, particularly with persons escaping a building in a panic situation.

Devices of this sort are well known, an example being disclosed by the U.S. Pat. No. 4,796,931 to George E. Heid which issued Jan. 10, 1989, and is assigned to my assignee. The Heid patent describes the linkages between the press bar and a latchbolt which is pivotally mounted adjacent the open end of the door.

Such structures have been designed to function under extreme conditions—the stampede of panicking adults toward the exit in a smoke-filled auditorium, for instance. A herd of such persons arriving at a closed door can exert a great outward force on the door and the exit device. A standard exit device test by Underwriters Laboratories replicating such conditions involves exerting a horizontal outward force of 250 pounds against a closed door to test the exit device installed thereon. A further test during the application of the 250 pound force described above, requires that the press bar operate at a force of less than 50 lbs. This press bar force augments the 250 pound force mentioned above so that the total outward force on the latch can be up to 300 pounds. To counter this enormous force in the opening direction, designers of exit devices have avoided the preferred more-secure reciprocating deadbolt with its high lateral friction and have adopted pivoted latchbolts. Such latchbolts have strike-engaging latching surfaces which are curved or beveled, thereby easing the resistance to retraction in the keeper as the door and exit device are pressed outward, but exerting lateral forces which separate the door and the frame thereby reducing door security.

In other words, while rectangular or square deadbolts, as known in the lock industry, offer better strength and security, they require a substantial force to slide them to retracted position under the above extreme conditions because of the large perpendicular forces acting on the bearing surfaces. Because failure of an exit device to open could be catastrophic, the preference for square or rectangular deadbolt-type locking members has been cast aside for the easier-opening pivoted latchbolt described above. As a result, doors equipped with pivoted latchbolts have been more vulnerable to vandalism. Also, in fire situations in which enormous heat has warped the door and frame, pivoted latchbolts have been known to foil and pop open during fire tests.

SUMMARY OF THE INVENTION

The present invention is directed to an exit device for a door comprising a securing member assembly which overcomes the aforementioned problems through the provision of an elongated member, such as a deadbolt or the like, for extending into a keeper mounted adjacent a free end of the door, the elongated member moveable longitudinally from an extended position to a retracted position; a pivoting member having a peripheral surface, the peripheral surface engaging a surface of the elongated member as the pivoting member pivots for retracting and supporting the elongated member from a direction opposite the direction the door opens; and means for actuating the pivoting member for moving the elongated member from the extended to the retracted position, the elongated member returning to the extended position when the actuating means is released. The actuating means of the securing member assembly may comprise a press bar assembly operatively connected to the pivoting member whereby the press bar, when pressed, will move the elevated member longitudinally from extended to retracted position. Further, the pivoting member may further comprise a keeper-engaging surface for engaging a keeper and pivoting the pivoting member to retract the elongated member as the door is closed. The pivoting member serves as an anti-friction bearing roller to shoulder the inward force of the elongated member during its retraction as the door is pushed open and the elongated member is pressed hard outward against its keeper in the door frame. The pivoting member also serves as an anti-friction device as the door closes to retract the elongated member as the keeper-engaging surface on the pivoting member forces the pivoting member to pivot and in turn drives back the elongated member. The securing member assembly for the exit device of the present invention may further comprise means for effecting deadlocking of the elongated member in the extended position and means for cancelling deadlocking of the elongated member.

Using a deadbolt as a securing member gives a mortise-lock degree of security to a surface-mounted exit device.

Accordingly, it is an object of this invention to provide an improved exit device having a deadbolt as its securing member.

A further object of this invention is to provide an improved exit device having a deadbolt as its securing member wherein the deadbolt is mounted adjacent a free end of the door for longitudinal movement from an extended to a retracted position.

A still further object of this invention is to provide an improved exit device having a deadbolt as its securing member which does not require substantial force to move the deadbolt from the extended to the retracted position.

Another object of this invention is to provide an exit device having a deadbolt as its securing member for a door having a press bar on the inside of the door to actuate the deadbolt.

Still another object of this invention is to provide an improved exit device having a deadbolt as its securing member which will meet the aforementioned requirement of opening under conditions of great outward force on the door and exit device.

A related object of this invention is to provide an improved exit device for a door having a press bar on the inside of the door to actuate the deadbolt, the door opening with minimal pressure on the press bar despite great outward force on the door.

Yet another object of this invention is to provide an exit device having an improved degree of security.

Similarly, an object of this invention is to provide an improved exit device which is less vulnerable to vandalism.

With more particularity, it is an object of this invention to provide an improved exit device having a deadbolt as its securing member with a deadlocking feature.

A feature of this invention is an elongated member, such as a deadbolt or the like, as the securing member of an exit device. A further feature of this invention is a pivoting member which upon actuation drives the deadbolt into a retracted position.

A still further feature of this invention is linking means connecting the press bar and deadbolt whereby when the press bar is pressed the deadbolt will move longitudinally from extended to retracted position.

Another feature of this invention is the pivoting member, generically referred to herein as a retractor blade, which serves as an anti-friction bearing roller to bear the force against the deadbolt in the door opening direction during retraction of the deadbolt as the door is pushed open and the deadbolt is pressed against its keeper.

A related feature of this invention is a bearing surface on the retractor blade bearing against a surface of the deadbolt for progressively rolling along the deadbolt surface as the deadbolt is retracted.

Still another feature of this invention is a keeper-engaging surface on the retractor blade which progressively engages the keeper as the door is closed and forces the retractor blade to pivot and retract the deadbolt.

The present invention has many advantages, including providing a more secure exit device than previously known as a result of the use of the deadbolt as the securing member.

BRIEF DESCRIPTION OF THE DRAWINGS

Further objects and features of the invention will be apparent to those skilled in the art from a reading of the following specification and reference to the drawings, all of which disclose a non-limiting embodiment of the invention. In the drawings.

DESCRIPTION OF THE PREFERRED EMBODIMENT

As used herein, the term "deadbolt" means an exit device component having an elongated end which projects from a free end of a door in an extended position, is withdrawn into the exit device in a retracted position by action of the exit device, and extends into a hole provided in the strike or keeper when the door is closed for securing the door in the closed position.

Figure 1:
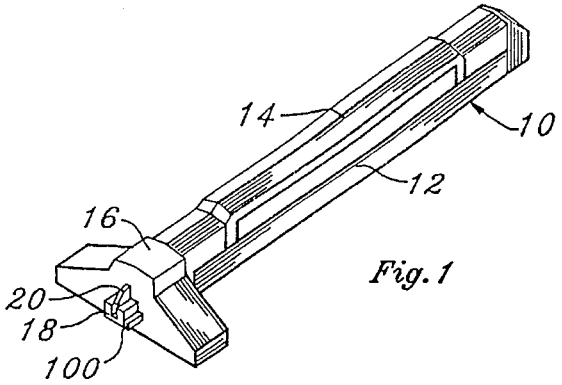
FIG. 1 is a perspective view showing an exit device embodying the invention.

An embodiment of the invention is shown in FIG. 1 and is generally designated 10. It is an exit device adapted to be mounted on a door and comprises an elongated housing 12 with a press bar 14 and a latch cover 16. Out of the latch cover extends a deadbolt 18, a retractor blade 20 as shown and a deadlocking plunger 100.

With the cover 16 removed the latch actuator comprises (FIG. 2) a base plate 22 having side plates 24 and 26. Parallel to and spaced above the base plate 22 is a blade pivot pin 28 which is sturdily secured between the side plates 24, 26. Pivotally mounted on the pin 28 is the retractor blade 20 which comprises an enlarged hub 30 with a transverse bore accepting the pin 28 and a thin blade portion 32 having a keeper contact surface 32*a*.

Disposed under the retractor blade 20 and resting on the base plate 22 is the deadbolt 18 which has on its forward upper surface a separate longitudinal cut-out 34 loosely receiving the blade portion 32. Spaced back from the front end of the deadbolt the cut-out 34 is enlarged laterally and receives an insert 36 preferably of sintered metal. As shown, the insert is formed with an inclined wall 38. The rearward end of the retractor blade 20 is formed with a nose 40 which butts against the surface of the inclined wall 38. The periphery of the blade portion 32 extends forward from the nose 40 in an arc 42 concentric with the axis of the pin 28. The arc transforms partway forward from the nose into a straight line 44.

The insert 36 backs up on a pair of spaced shoulders 46 on either side of a longitudinal cut-out 48 (FIG. 7) midway along the length of the deadbolt. The cut-out 48 is formed with opposed faces 50 which jog inward spaced from the bottom of the bolt to present flanges 52. The flanges in their inner most faces are spaced from each other and parallel thereto. Upwardly facing shoulders 52*a* are presented on top of the flanges.

Spaced back from the front end of the deadbolt its undersurface is upwardly recessed as at 54 from its midsection to its rear end. The base plate 22 is formed with a window 56 and a bolt plate 58 having a downward offset 60 dipping into the window 56 overlies the base plate 22 from the window 56 rearward.

Figure 9:
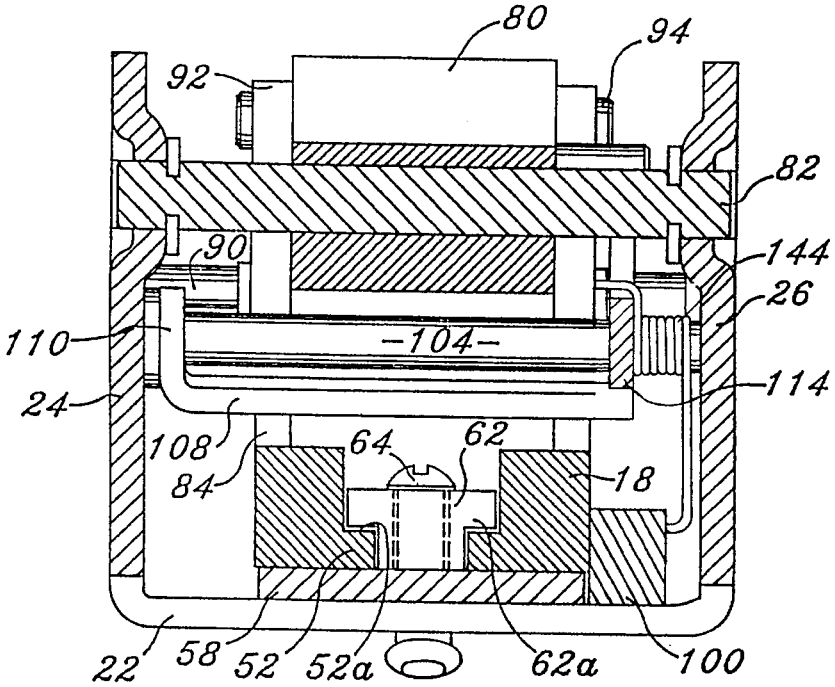
FIG. 9 is an enlarged sectional view taken on the line 9—9 of FIG. 4.

Surmounting the spacing plate 58 is a T-shaped deadbolt stabilizer 62 (FIG. 9). The three elements: base plate 22, bolt plate 58 and the T-shaped stabilizer 62 are clampingly secured together by a pair of bolts 64 which extend through apertures in the stabilizer 62, the bolt plate 58 and are threaded into the base plate holes 66. A mounting plate 68 (FIG. 7) is secured to the base plate 22 and has an opening 70 therein to pass the front end of the deadbolt 18.

Figure 7:
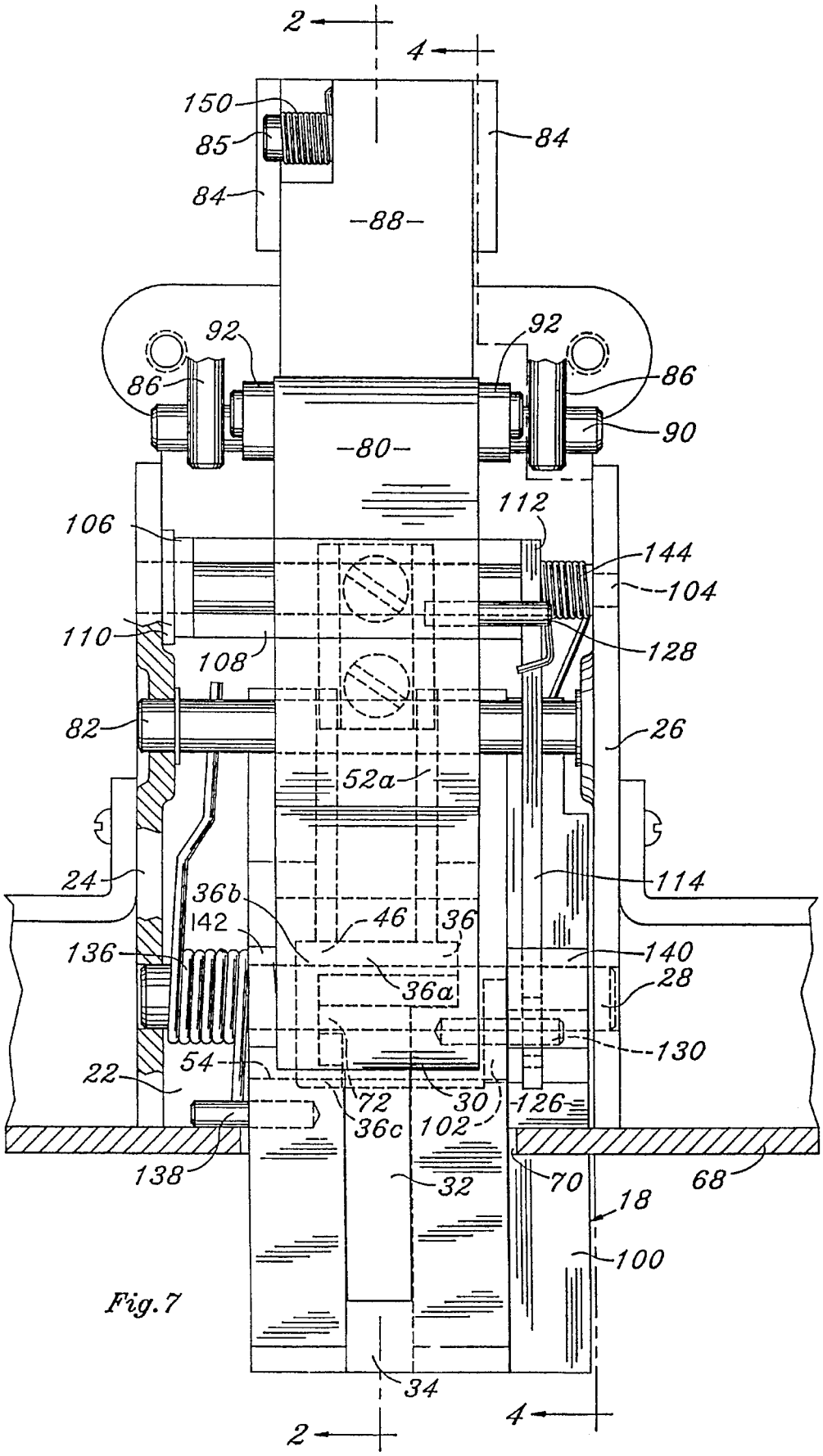
FIG. 7 is a top plan view of the parts of FIG. 2 with the deadbolt extended.

The retractor blade 20 has extending laterally from its nose area 40 a lug 72 (FIGS. 2, 8) which provides a connection for interrelated movement between the retractor blade 20 and the deadbolt 18. As best shown in FIG. 7, the insert 36 which nestles in its recess in the deadbolt has rear wall 36*a*, side wall 36*b* and a partial front wall 36*c*.

While the front end of the deadbolt is partly retained in position by the configuration of the opening 70 in the mounting plate 68 the rear end is stabilized by the stabilizer 62. As shown best in FIG. 9, the flanges 62*a* comprising the upper portion of the T-shaped stabilizer 62 overlie the upwardly facing shoulders 52*a* on flanges 52 in the cut-out 48 at the rearward end of the deadbolt. Thus, the deadbolt is able to travel in a controlled longitudinal direction from extended to retracted position and back again.

Figure 2:
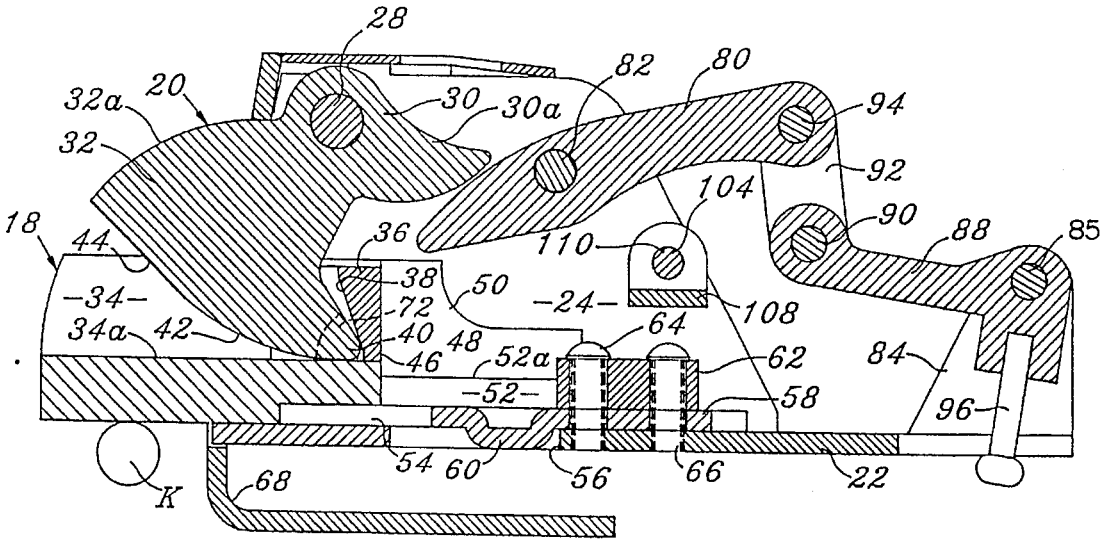
FIG. 2 is a sectional view of the actuator of an exit device embodying the invention taken on the line 2—2 of FIG. 7 and showing the deadbolt extended as with the door opened.
Figure 3:
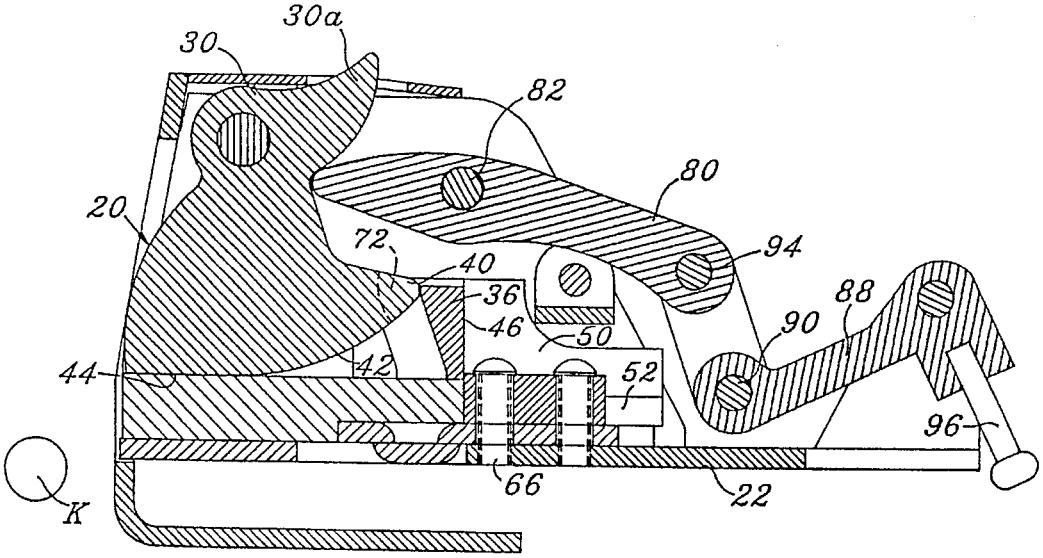
FIG. 3 is similar to FIG. 2 but showing the deadbolt retracted as when the press bar is depressed.

As shown in FIGS. 2 and 3, the retraction of the deadbolt may be driven by the retractor blade 20 as its lobe 30*a* is raised by linkages to be described. As the nose 40 of the retractor blade 20 drives into the rear wall 36*a* of the insert 36 it moves the deadbolt toward retracted position. Engagement of the lug 72 with the front wall 36*c* of the insert, assures that the retractor blade will not extend when the deadbolt is retracted.

When there is an inward force on the deadbolt all during the relative movement of the retractor blade 20 and the deadbolt 18, the periphery surface 42 of the retractor blade bears on the bearing surface floor 34*a* of the cut-out 34. Thus, the great bearing force tending as in the panic situation described above to move the deadbolt from its bolt plate 58 is countered by the reaction of the surface 42 of the retractor blade 20 against the floor 34*a* and the pivot pin 28.

Part of the linkage between the press bar and the retractor blade 20 is a retractor lever 80. This is pivoted intermediate its ends on a 82 sturdily bridging between the side plates 24, 26 rearward of the retractor blade. The upper surface of the leftward side (FIG. 2) of the retractor lever 80 is shaped to engage and press underneath the lobe 30*a* of the retractor blade 20 so that when the rightward side of the retractor lever 80 is depressed, the leftward side urges the lobe 30*a* upward, rotating the retractor blade in counter-clockwise motion as seen in FIG. 2.

A parallel pair of ears 84 extend upward from the base plate 22 to the rightward side of the side plates 24, 26 (FIG. 2). These ears are formed with aligned openings in which is secured a pin 85. To the pin 85 is pivotally secured a dog-bone lever 88 which has a leftward side through which extends a pin 90. Pivoted links 92 extend on either side of the lever 80 and dog-bone lever 88 connecting the pin 90 and a pin 94, the latter extending through the rightward end of the retractor lever 80. Downward motion of the rightward side of lever 80 is accomplished when the press bar is pushed in as in opening the door. The press bar has a pair of fingers 86 (FIG. 7) and these engage the upper side of the extensions of pin 90. The downward side of the dog-bone lever 88 includes a headed projection 96 as is well known in the art by which the outside cylinder or other operator for the exit device may actuate the deadbolt. The connection between the outside cylinder and the headed projection 96 will not be described herein, it being well disclosed in the Heid patent mentioned above.

Figure 8:
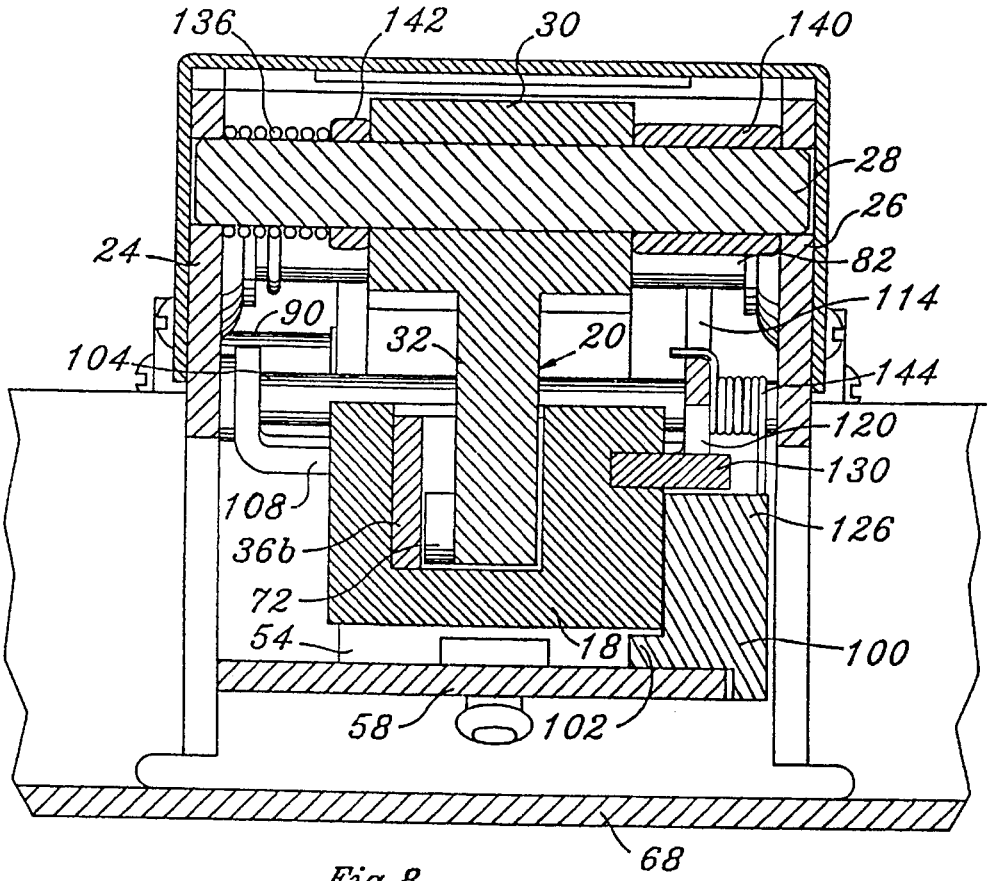
FIG. 8 is an enlarged sectional view taken on the line 8—8 of FIG. 4.

Deadlocking plunger 100 operates in a manner well known in the art. Briefly, it is an elongated element which is contiguous to a side of deadbolt 18 (FIG. 8). It moves or is moved from an extended position shown in FIG. 4 to a retracted position shown in FIG. 5. Intermediate its ends it is formed with a foot 102 which fits into the recess 54 on the underside of the deadbolt 18 (FIG. 2). Otherwise, the deadlocking plunger is stabilized by the inner side of the side plate 26 and the shape of the opening in the cover 16 as shown in FIG. 1 and as is conventional.

Figure 4:
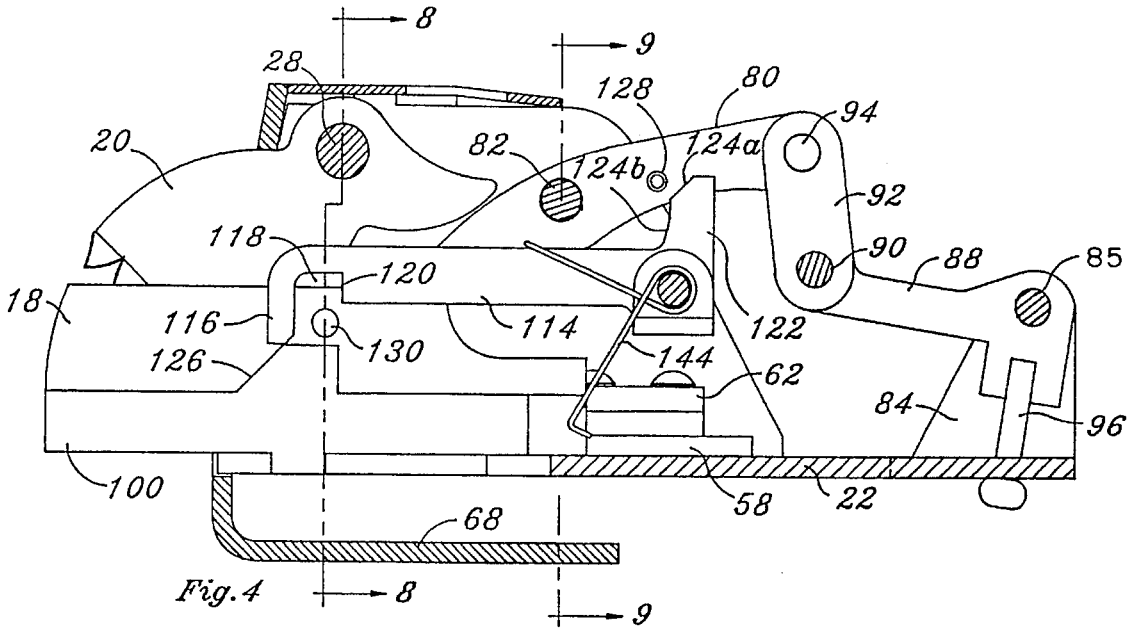
FIG. 4 is a sectional view taken on the line 4—4 of FIG. 7 showing the deadbolt extended as in FIG. 2 and showing the deadlocking plunger extended.
Figure 5:
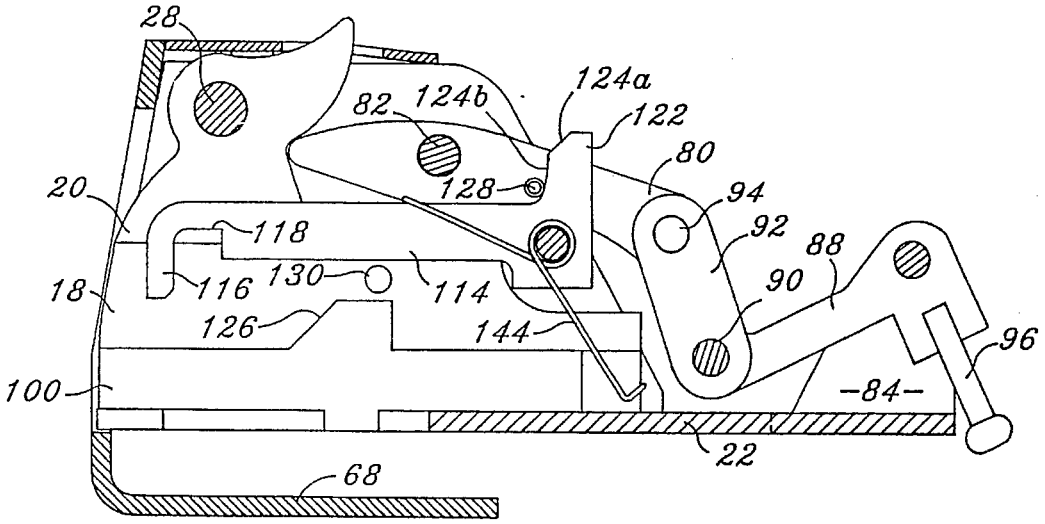
FIG. 5 is similar to FIG. 4 but showing the parts as with the exit device press bar depressed.

The deadlocking linkage includes a pin 104 which extends between a side plates 24, 26 and journals the yoke 106 which is of U-shape having an elongated bight 108 (FIG. 9) and upward legs 110, 112. The leg 112 has a long forward extension forming a deadlocking arm for effecting deadlocking of the deadbolt 114 (FIG. 4). For this purpose, the distal end of the deadlocking arm 114 has a downward toe 116 and a downwardly facing notch 118 which includes a blocking surface 120 for deadlocking of the deadbolt when the deadbolt is in the keeper as will be described below. Leg 112 also has an upward driver arm 122 (FIG. 4) terminating in a cam surface 124 including an inclined portion 124*a* and a generally vertical portion 124*b*.

The deadlocking plunger 100 is formed with a trapizoidal upward cam 126 (FIG. 4) intermediate its ends, and the retractor lever 80 is formed with a transverse pin 128, the trapezoidal cam 126 and the transverse pin 128 forming first and second actuator means, respectively, for the deadlocking linkage as will be explained. Beefy deadlocking pin 130 extends out transversely from the deadbolt 18 (FIG. 4).

Various springs are provided. A torsion spring 136 winds around the pin 28 on the leftward side of the deadbolt 18 (FIG. 7). One end of the spring 136 rests under the pin 82 and the other end engages under a pin 138 which extends out from the leftward side of the deadbolt 18 (FIG. 7). The spring 136 is under stress so that it biases the deadbolt 18 in the extended position, and pin 138 additionally provides a stop, hitting against the mounting plate 68 to limit the extension of the deadbolt.

Spacer 140 surrounds the pin 28 on the rightward side of the hub 30 of the retractor blade and a smaller spacer 142 (FIG. 8) is disposed between the spring 136 and the leftward side of the hub 30, both to suitably position the retractor blade 20 so that the blade portion 32 is aligned with the cutout 34 in the deadbolt.

A second spring 144 (FIG. 7) is a torsion spring which is disposed about the deadlocking linkage pin 104. Its purpose is to bias the deadlocking arm 114 downward so that the notch 118 receives the pin 130. One end of the spring 144 engages over the top of the arm 114 while the other end engages the rear surface of the deadlocking plunger 100. The spring 144 is under stress to bias the arm 114 as described. The other end of the spring 144 pushes outward against the deadlocking plunger 100.

A third torsion spring 150 (FIG. 7) biases the dog-bone lever in a clockwise direction (FIG. 4).

The general operation of a deadlocking mechanism is well known to those skilled in the art. In the embodiment described, when both the deadbolt 18 and the deadlocking plunger 100 are extended (FIG. 4), the trapezoidal cam 126 of the plunger engages the toe 116 of the deadlocking arm 114 to hold the notch 118 and blocking surface 120 up clear for cancelling the deadlocking action of the deadlocking arm 114 and allowing for the rearward movement of the deadbolt pin 130. The deadbolt, thus, is free to retract on the closing of the door, being driven by the engagement of the keeper roller K (FIG. 2) with the curved front keeper contact surface 32*a* of the blade portion 32. In this scenario, the keeper roller K forces the retractor blade in counter-clockwise direction so that its nose 40 engages the surface of the inclined wall 38 of the insert 36 which is part of the deadbolt and drives the latter toward retracted position. Engagement of the front end surface of recess 54 in the underside of the retracting deadbolt with the foot 102 on the plunger drives back the deadlocking plunger 100. Once the deadbolt is past the keeper roller K, it snaps outward being driven out by spring 136 to lock the door.

Because the opening in the keeper permits the intrusion of the deadbolt 18 but not the deadlocking plunger 100, the latter cannot extend and, hence, the cam 126 is rearward of the toe 116 (FIG. 6) and the deadlocking arm 114 rests with the top of the notch 118 on the pin 130 so that attempts to violate the lock by forcing the deadbolt inward are frustrated as the pin 130 hits the blocking surface 120. Recess 54 which encloses foot 102 on the deadlocking plunger 100 is long enough to permit the deadbolt to extend while the deadlocking plunger 100 is held by the strike in depressed or nearly depressed position.

Upon the actuation of the press bar 14, the pins 86 (FIG. 7) press the ends of the sturdy pin 90 downward, rotating the retractor lever 80 in a clockwise direction. This causes the transverse pin 128 to move against the cam surface 124*a*, 124*b* of the upward driver arm 122 and pivot the deadlocking arm 114 in a clockwise direction raising the arm 114 so that the notch 118 raises (FIG. 5), moving the blocking surface 120 out of the path of the pin 130 thereby cancelling the deadlocking action of the deadlocking arm 114 and allowing for subsequent retraction with the deadbolt 18. Continued movement of the press bar causes the top of the leftward side of the retractor lever 80 to work under the lobe 30*a* of the retractor blade 20 causing its counter-clockwise rotation. As will be understood by now, the nose 40 works against the wall 38 of the insert 36, part of the deadbolt 18, to retract the deadbolt. Engagement of the front end surface of recess 54 in the underside of the retracting deadbolt with the foot 102 on the deadlocking plunger 100, drives back the deadlocking plunger.

At all times during which pressure is put on the door with deadbolt in its keeper, the bearing surface 42 of the retractor blade 20 bears against the surface 34*a* of the floor of the cutout 34 and the pivot pin 28. This provides an anti-friction means for overcoming what can be a very substantial bearing force working to displace the deadbolt inward as force is exerted inward by the keeper roller K.

Clearly, once the front of the deadbolt 18 clears the keeper roller K, the door is free to move open. When pressure is released from the press bar, the spring 136 drives the deadbolt outward and spring 144 drives the deadlocking plunger 100 outward. The lock returns to the condition described and as shown in FIGS. 2 and 4.

The provision of the retractor blade 20 and its bearing surface 42 make possible the use of a deadbolt in the present exit device. Repeating, the rolling surface 42 and pivot pin 28 effectively oppose the pressure (FIG. 1) exerted by the keeper roller K tending to displace the deadbolt inward against adjacent structures. By means of the retractor blade with its bearing surface and pivot pin, the industry is finally able to have an exit device featuring a deadbolt as its securing means with the concomitant improvement in security. If desired or necessary, anti-friction coatings may be used on the deadbolt and other parts to reduce friction and make the operation even smoother.

Although the present invention has been described in considerable detail in connection with a preferred embodiment thereof, it will be understood, of course, that I do not intend to limit the invention to that embodiment since modifications may be made by those skilled in the art, particularly in light of the foregoing teachings. For example, an exit device having a deadbolt as its securing is effective where any type of activating means is employed for pivoting the retractor blade, including vertical door rod exit devices. On the contrary, I intend to cover all alternatives, modifications and equivalents as may be included within the spirit and scope of the invention as defined by the appended claims. It is, therefore, contemplated by the appended claims to cover any such modifications as incorporating those features which constitute the essential features of these improvements within the true spirit and scope of the invention. Therefore, the spirit and scope of the appended claims should not be limited to the description of the preferred embodiment contained herein.

What is claimed is:

1. An exit device adapted to be mounted on a pivoting door, the exit device comprising:

a. a frame including a base plate having a longitudinal axis and side plates secured to and extending from either side of the base plate, b. a pin secured to and extending between the side plates spaced from the base plate, c. a deadbolt between the pin and the base plate, the deadbolt having a longitudinal axis parallel to the longitudinal axis of the base plate and slidable longitudinally with respect to the longitudinal axis of the base plate from an extended position to a retracted position and having an abutment surface, d. a retractor blade pivotally mounted on the pin for movement from an extended position to a retracted position, the retractor blade having on a periphery a nose adapted to engage the abutment surface, a deadbolt pressure surface extending along the periphery from the nose and adapted as the retractor blade pivots and the deadbolt slides to roll progressively along a longitudinal surface on the deadbolt, and a strike-plate-engaging surface for engaging a strike plate as the door closes for pivoting the retractor blade to the retracted position as the nose engages the abutment surface and retracts the deadbolt, e. a manually operated press bar assembly operatively connected to the retractor blade so that when the press bar is pushed the retractor blade pivots to the retracted position as the nose engages the abutment surface and retracts the deadbolt, and f. a spring for urging the deadbolt toward the extended position.

2. An exit device as claimed in claim 1, further comprising means for effecting deadlocking of the deadbolt.

3. An exit device as claimed in claim 2, further comprising a projection extending transversely out from the deadbolt and wherein the deadlocking effecting means is adapted for moving from a blocking position to a clearing position with respect to the projection.

4. An exit device as claimed in claim 3, wherein the deadlocking effecting means comprises an arm pivotally secured on the frame, the arm having a blocking surface adapted in the blocking position of the arm to be disposed in the path of the projection for preventing the deadbolt from being depressed from the extended position.

5. An exit device as claimed in claim 4, further comprising means for cancelling deadlocking of the deadbolt.

6. An exit device as claimed in claim 5, wherein the deadlocking cancelling means comprises a first actuator means for moving the arm from the blocking to the clearing position.

7. An exit device as claimed in claim 6, wherein the deadlocking cancelling means further comprises a second actuator means for moving the arm from the blocking to the clearing position.

8. An exit device as claimed in claim 7, wherein the second arm moving actuator means comprises an extension on the press bar assembly for engaging the arm when the press bar is pushed and moving the arm from the blocking position to the clearing position.

9. An exit device as claimed in claim 8, wherein the first arm moving actuator means comprises a deadlocking plunger adjacent the deadbolt, the deadlocking plunger having a cam surface for moving the arm to the clearing position and holding the arm in the clearing position when the deadlocking plunger is extended.

10. An exit device for a door, comprising a frame having a longitudinal axis, a deadbolt in the frame, the deadbolt having a longitudinal axis parallel to the longitudinal axis of the frame, means for retracting the deadbolt pivotally mounted on the frame, the retracting means having a peripheral surface for engaging and rolling along a longitudinal deadbolt surface as the retracting means pivots for supporting the deadbolt, a pressbar assembly mounted on the frame operatively connected to the retracting means for pivoting the retracting means when the pressbar is pushed, and means for engaging the retracting means and the deadbolt for retracting the deadbolt when the retracting means pivots.

11. An exit device as claimed in claim 10, wherein the retracting means is formed with a keeper-engaging surface for engaging a keeper and pivoting the retracting means to retract the deadbolt as the door is closed.

12. An exit device as claimed in claim 11, wherein the engaging means comprises a non-longitudinal surface on the deadbolt and a retracting surface on the retracting means for engaging the non-longitudinal surface of the deadbolt as the retracting means pivots to retract the deadbolt.

13. An exit device as claimed in claim 12, further comprising means for effecting deadlocking of the deadbolt.

14. An exit device as claimed in claim 13, further comprising a projection extending transversely out from the deadbolt and wherein the deadlocking effecting means is adapted for moving from a blocking position to a clearing position with respect to the projection.

15. An exit device as claimed in claim 14, wherein the deadlocking effecting means comprises an arm pivotally secured on the frame, the arm having a blocking surface adapted in the blocking position of the arm to be disposed in the path of the projection for preventing the deadbolt from being depressed from the extended position.

16. An exit device as claimed in claim 14, further comprising means for cancelling deadlocking of the deadbolt.

17. An exit device as claimed in claim 16, wherein the deadlocking cancelling means comprises a first actuator means for moving the deadlocking effecting means from the blocking position to the clearing position.

18. An exit device as claimed in claim 17, wherein the deadlocking cancelling means further comprises a second actuator means for moving the deadlocking effecting means from the blocking position to the clearing position.

19. An exit device as claimed in claim 18, wherein the second actuator means for moving the deadlocking effecting means comprises an extension on the press bar assembly for engaging the deadlocking effecting means when the press bar is pushed and moving the deadlocking effecting means from the blocking position to the clearing position.

20. An exit device as claimed in claim 17, wherein the first actuator means for moving the deadlocking effecting means comprises a deadlocking plunger adjacent the deadbolt, the deadlocking plunger having a cam surface for moving the deadlocking effecting means to the clearing position and holding the deadlocking effecting means in the clearing position when the deadlocking plunger is extended.

21. An exit device, comprising:

a. means for supporting the exit device adapted to be mounted on a pivoted door, the supporting means having a longitudinal axis, b. means for actuating the exit device, c. a deadbolt in the supporting means, the deadbolt having a longitudinal axis parallel to the longitudinal axis of the supporting means and longitudinally moveable with respect to the longitudinal axis of the supporting means from an extended to a retracted position, and d. means for linking the actuating means and the deadbolt for moving the deadbolt from the extended to the retracted position when the actuating means is actuated, the linking means having a bearing surface aligned with a longitudinal deadbolt surface for supporting the longitudinal movement of the deadbolt, the deadbolt returning to the extended position when the actuating means is released.

22. An exit device as claimed in claim 21, wherein the linking means comprises a retractor/bearing member pivotally mounted in the supporting means.

23. An exit device as claimed in claim 22, wherein the deadbolt has a non-longitudinal surface and the retractor/bearing member has a retracting surface for engaging the non-longitudinal surface of the deadbolt as the retractor/bearing member pivots for retracting the deadbolt.

24. An exit device as claimed in claim 23, wherein the retracting surface comprises a projecting nose.

25. An exit device as claimed in claim 24, wherein the retractor/bearing member has a keeper-engaging surface spaced from the projecting nose and wherein the bearing surface is disposed intermediate the projecting nose and the keeper-engaging surface.

26. An exit device as claimed in claim 22, wherein the bearing surface of the retractor/bearing member engages and rolls along the deadbolt surface as the retractor/bearing member pivots.

27. An exit device as claimed in claim 26, further comprising means for effecting deadlocking of the deadbolt.

28. An exit device as claimed in claim 27, wherein the deadlocking effecting means is adapted to be moved from a blocking position to a clearing position with respect to the deadbolt, the deadlocking effecting means adapted in the blocking position to be disposed in the path of the deadbolt for preventing the deadbolt from being depressed from the extended position.

29. An exit device as claimed in claim 28, wherein the deadlocking effecting means comprises an arm pivotally secured on the frame means, the arm having a blocking surface adapted in the blocking position of the arm to be disposed in the path of the deadbolt for preventing the deadbolt from being depressed from the extended position.

30. An exit device as claimed in claim 28, further comprising means for cancelling deadlocking of the deadbolt.

31. An exit device as claimed in claim 30, wherein the deadlocking cancelling means comprises means for moving the deadlocking effecting means from the blocking position to the clearing position.

32. An exit device as claimed in claim 31, wherein the the means for moving the deadlocking effecting means comprises an extension on the linking means which engages the deadlocking effecting means when the actuating means is actuated for moving the deadlocking effecting means from the blocking to the clearing position.

33. An exit device as claimed in claim 31, wherein the means for moving the deadlocking effecting means comprises a deadlocking plunger, the deadlocking plunger having a cam surface which moves the deadlocking effecting means to the clearing position and holds it in the clearing position when the deadlocking plunger is extended.

34. A securing member assembly for an exit device of a pivoted door, the securing member assembly comprising:

a. an elongated member for extending into a keeper mounted adjacent a free end of the door, the elongated member having a longitudinal axis and moveable longitudinally along the axis from an extended position to a retracted position, the elongated member having a retracting surface and a longitudinal bearing surface;

b. a pivoting member having a peripheral surface, the peripheral surface engaging the elongated member retracting and bearing surfaces as the pivoting member pivots for simultaneous retraction and rolling support of the elongated member; and c. means for actuating the pivoting member for moving the elongated member from the extended to the retracted position, the elongated member returning to the extended position when the pivoting member actuating means is released.

35. A securing member assembly for an exit device as claimed in claim 34, wherein the actuating means comprises a press bar assembly operatively connected to the pivoting member for pivoting the pivoting member when the press bar is pushed to for retracting the elongated member and opening the door.

36. A securing member assembly for an exit device as claimed in claim 34, wherein the pivoting member further comprises a keeper-engaging surface for engaging a keeper as the door is closed for pivoting the pivoting member and retracting the elongated member.

37. A securing member assembly for an exit device as claimed in claim 34, further comprising means for deadlocking the elongated member in the extended position.

38. A securing member assembly for an exit device as claimed in claim 37, further comprising means for cancelling deadlocking of the elongated member.

* * * * *

UNITED STATES PATENT AND TRADEMARK OFFICE

CERTIFICATE OF CORRECTION

PATENT NO. : 5,605,362

DATED : February 25, 1997

INVENTOR(S) : Walter E. Surko, Jr.

Figure 6:
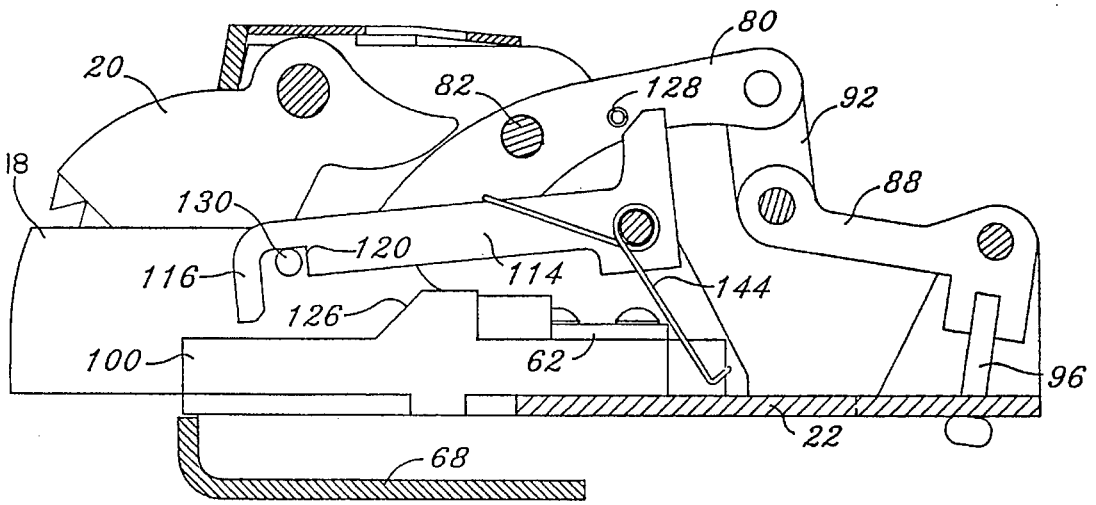
FIG. 6 is similar to FIG. 4 but showing the parts as with the door closed and the deadbolt in the deadlocked position on the door frame and the deadlocking plunger abutting the strike plate.

It is certified that error appears in the above-indentified patent and that said Letters Patent is hereby corrected as shown below:

In the drawings, Sheet 2, Figs. 4 and 6, at reference numeral 20, delete the stray lines highlighted in red ink.

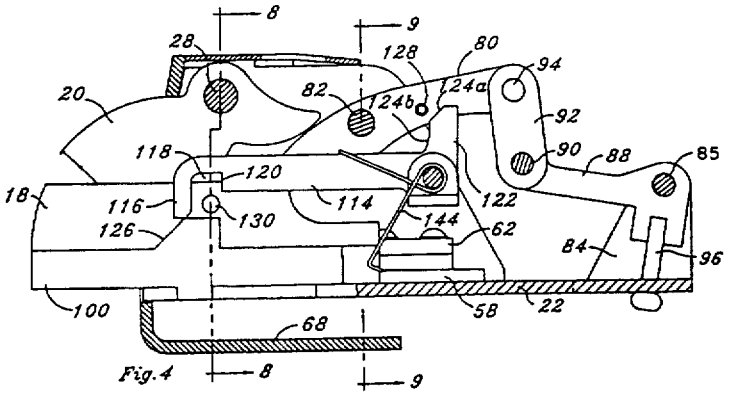

Fig.4

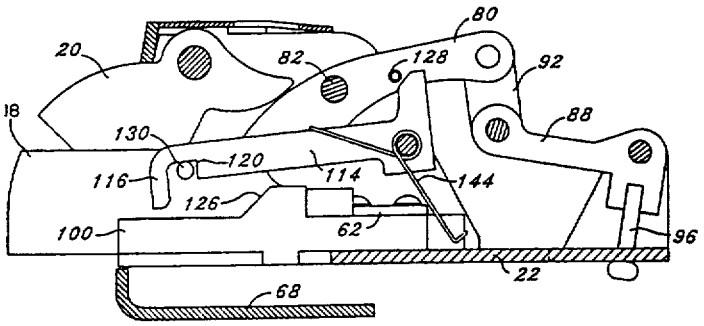

Fig.6

UNITED STATES PATENT AND TRADEMARK OFFICE

CERTIFICATE OF CORRECTION

PATENT NO. : 5,605,362

DATED : February 25, 1997

INVENTOR(S) : Walter E. Surko, Jr.

It is certified that error appears in the above-indentified patent and that said Letters Patent is hereby corrected as shown below:

Column 1, line 7, after "having" insert --a--.
Column 1, line 63, change "foil" to --fail--.
Column 2, line 17, change "elevated" to --elongated--.
Column 4, line 47, change "spacing" to --bolt--.
Column 5, line 22, after "a" insert --pin--.
Column 6, line 6, change "trapizoidal" to --trapezoidal--.
Column 5, line 63, after "arm" insert --114--.
Column 5, line 64, delete "114".

Signed and Sealed this

FourthDay of August, 1998

Bruce Lehman

*Attest:*

BRUCE LEHMAN

*Attesting Officer*

*Commissioner of Patents and Trademarks*